US006651876B2

(12) United States Patent
Scott

(10) Patent No.: US 6,651,876 B2
(45) Date of Patent: Nov. 25, 2003

(54) SLIDE SHUTTER FOR FOOD/CUFF PASS

(75) Inventor: Carl T. Scott, Kershaw, SC (US)

(73) Assignee: Habersham Metal Products Company, Cornelia, GA (US)

( * ) Notice: Subject to any disclaimer, the term of this patent is extended or adjusted under 35 U.S.C. 154(b) by 0 days.

(21) Appl. No.: 10/042,569

(22) Filed: Nov. 20, 2001

(65) Prior Publication Data

US 2003/0094819 A1 May 22, 2003

(51) Int. Cl.[7] ..... B65D 91/00

(52) U.S. Cl. ..... 232/43.1; 232/44; 109/67; 292/28

(58) Field of Search ..... 70/63; 232/43.1, 232/43.4, 43.5, 44, 19, 22; 220/345.1, 345.2, 476; 49/68, 413, 366, 367, 370, 449; 206/0.8; 292/228, 226, 238, 202, 203; 312/175, 292, 326, 139.2; 109/67, 68

(56) References Cited

U.S. PATENT DOCUMENTS

| | | | | | |
|---|---|---|---|---|---|
| 952,173 | A | * | 3/1910 | Zitko | 220/477 |
| 1,784,743 | A | | 12/1930 | Montgomery | |
| 2,027,491 | A | | 1/1936 | Percy | |
| 4,120,124 | A | | 10/1978 | Temple et al. | |
| 4,149,474 | A | | 4/1979 | Ruane | |
| 4,245,776 | A | * | 1/1981 | Miner | 232/43.3 |
| 4,351,247 | A | | 9/1982 | Clark | |
| 4,517,901 | A | | 5/1985 | Clark | |
| 4,571,901 | A | | 2/1986 | Morris et al. | |
| 4,763,444 | A | | 8/1988 | Ritchie | |
| 4,800,822 | A | | 1/1989 | Adkins | |
| 4,888,915 | A | * | 12/1989 | Goldenberg | 49/181 |
| D312,014 | S | | 11/1990 | Friedman | |
| 5,205,224 | A | | 4/1993 | Durst | |
| 5,820,170 | A | * | 10/1998 | Clancy | 292/26 |
| 6,182,402 | B1 | | 2/2001 | Aalst | |
| 6,247,641 | B1 | * | 6/2001 | Noblet et al. | 232/17 |
| 6,302,325 | B1 | * | 10/2001 | Alexander | 232/43.1 |
| 6,378,769 | B1 | * | 4/2002 | Wolgamot | 232/44 |

* cited by examiner

*Primary Examiner*—Robert J. Sandy
(74) *Attorney, Agent, or Firm*—Hinkle & O'Bradovich, LLC

(57) ABSTRACT

A self-latching slide door apparatus for food/cuff passes on prison doors is disclosed. The apparatus includes a main body connected to a front panel. The front panel includes slide doors that cover an aperture in the front panel when in a closed state. The slide doors have self-latching devices that lock the doors when in the closed position, therefore requiring no additional locks.

7 Claims, 3 Drawing Sheets

SLIDE SHUTTER FOR FOOD/CUFF PASS

BACKGROUND OF THE INVENTION

I. Field of the Invention

The present invention relates generally to the field of metal equipment and more generally to a self-latching slide door for a food/cuff aperture on prison doors.

II. Description of the Related Art

Prison cells require an opening to perform activities including passing items such as food and to perform functions such as cuffing prisoners. The small apertures used to perform these activities must be locked in order to keep the prisoner from gaining any outside access from the cell. Doors with locks are provided on the apertures. There are often spaces between the doors that allow prisoners to sometimes pass thin objects and pick the locks. Furthermore, prison guards must carry keys to unlock the doors. Sometimes prisoners can gain access to the keys and use the keys as weapons.

SUMMARY OF THE INVENTION

In accordance with the present invention and the contemplated problems which have and continue to exist in this field, the invention features a self-latching slide door apparatus for food/cuff passes on prison doors.

In general, in one aspect, the invention features a slide door apparatus, including a main body, a front panel connected to the main body, at least one door connected to the front panel and a latch connected to the door.

In one implementation, the apparatus includes an upper and lower support rail connected to the front panel, wherein the door is located between the upper and lower support rails.

In another implementation, the upper support rail comprises at least one notch adapted to receive an engagement portion of the latch.

In another implementation, the apparatus includes a latch stop located near the notch.

In another implementation, the latch is spring-loaded within the bracket.

In another implementation, the main body is hollow and rectangular.

In still another implementation, the front panel includes an aperture that is flush with the perimeter of the main body.

In yet another implementation, the door is in a closed state when the engagement portion is engaged with the notch.

In another aspect, the invention features a self-latching slide door apparatus, including a hollow and rectangular main body, a front panel having an aperture flush with the perimeter of the main body, an upper and lower support rail connected to the front panel, a first and second door held within the upper and lower support rails, and a self-latching device connected to the each of the doors.

In one implementation, the self-latching device includes a bracket, a latch spring-loaded within the bracket, the latch having an engagement portion and a handle portion and a pin pivotally connecting the latch to the bracket.

In another implementation, the apparatus includes a first notch located in the upper support rail and adapted to receive the engagement portion of the latch of the first door, the first notch being located so that when the engagement portion of the first door is engaged with the notch, the first door covers substantially half of the aperture and a second notch located in the upper support rail and adapted to receive the engagement portion of the latch of the second door, the second notch being located so that when the engagement portion of the second door is engaged with the notch, the second door covers substantially the remaining half of the aperture.

In another implementation, the apparatus includes a first latch stop located near the first notch in a position that prevents the latch of the first door from moving past the first latch stop and a second latch stop located near the first notch in a position that prevents the latch of the second door from moving past the second latch stop.

In another implementation, the apparatus includes a plate connected to the first door, wherein the plate overlaps the second door when doors cover the aperture.

In another aspect, the invention features a door system, including a door having a front surface and a rear surface, and having a pass opening a slide door apparatus, including a hollow main body fit flush within the pass opening, a front panel in contact with the front surface of the door and having an aperture flush with the perimeter of the main body, a rear panel surrounding the main body and in contact with the rear surface of the door, an upper and lower support rail connected to the front panel, a first and second door held within the upper and lower support rails and a self-latching device connected to the each of the doors.

In one implementation, the self-latching device comprises a bracket, a latch spring-loaded within the bracket, the latch having an engagement portion and a handle portion and a pin pivotally connecting the latch to the bracket.

In another implementation, the first and second doors are adapted to be in a closed state and an open state.

In another implementation, the system includes a plate connected to the first door.

In another implementation, the plate overlaps the second door when the doors are in the closed state, the plate covering a space between the first and second doors.

In another aspect, the invention features a slide door apparatus, including a hollow main body connected to a front panel having slide doors, and means to self-latch the slide doors to the front panel to cover a aperture in the front panel.

One advantage of the invention is that the it does not require the use of a key to lock the door.

Another advantage of the invention is that it provides a positive self-latching feature.

Other objects, advantages and capabilities of the invention will become apparent from the following description taken in conjunction with the accompanying drawings showing the preferred embodiment of the invention.

DETAILED DESCRIPTION OF THE INVENTION

Figure 1:
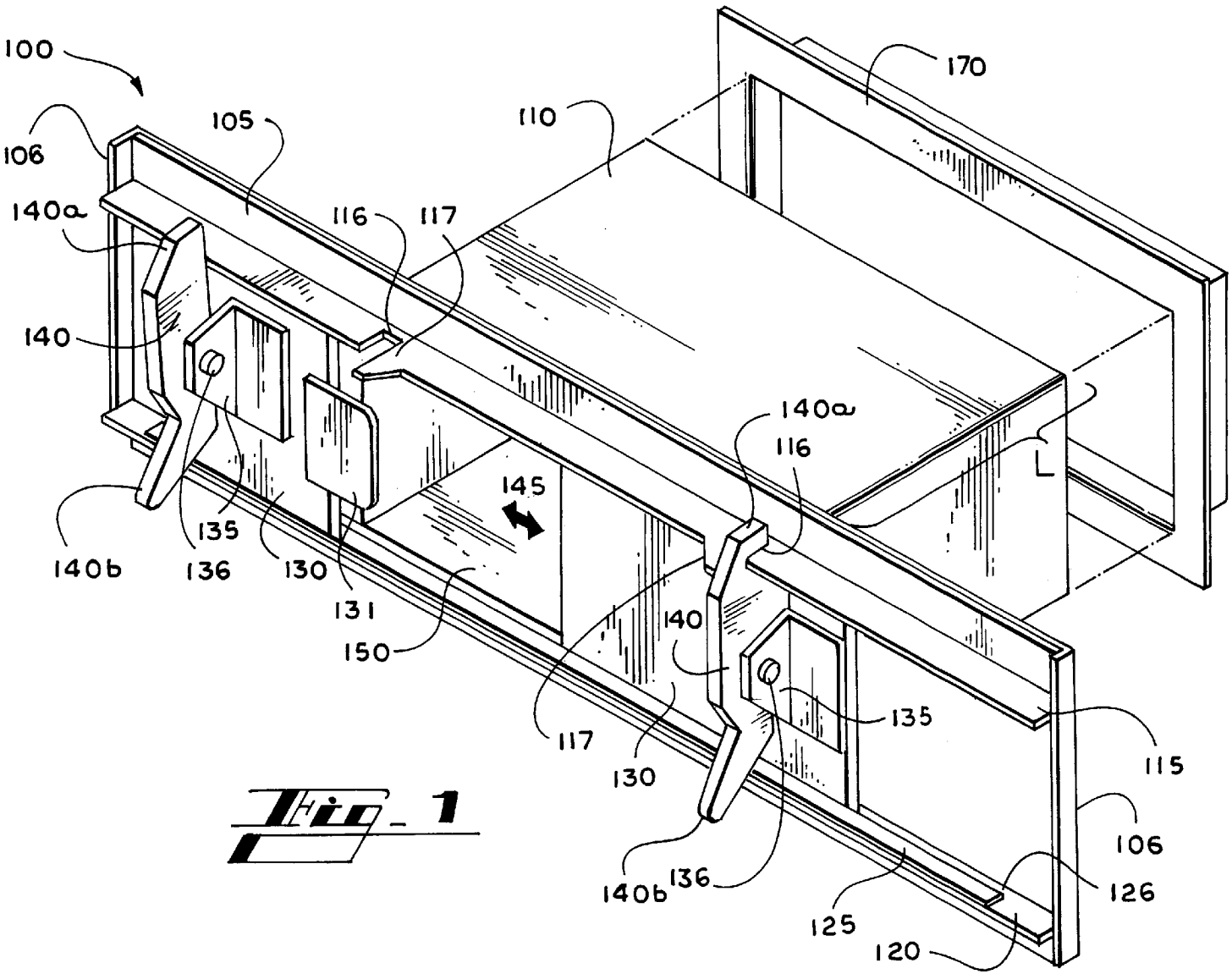
FIG. 1 illustrates a perspective view of an embodiment of a self-latching slide door apparatus.

Referring to the drawings wherein like reference numerals designate corresponding parts throughout the several figures, reference is made first to FIG. 1 which illustrates a perspective view of an embodiment of a self-latching slide door ("slide door") apparatus 100. The slide door 100 includes a main body 110 that is typically a hollow rectangular body having a length L, the length L being long enough to place items on the lower inner surface of the body 110.

One end of the body 110 is connected to a front panel 105 that is typically wider and higher than the body 110. The front panel includes an aperture 150 providing an opening to the main body 115. The front panel 105 further includes an upper support rail 115 and a lower support rail 120. The front panel 105 also includes two end lips 106 protruding from the front surface of the front panel 105 that provide lateral support for the upper and lower support rails 115, 120. An elongated lip (not shown, but shown below) on the upper support rail 115 and an elongated lip 125 on the lower support rail 120 form a track space 126 on which slide doors 130 can travel side to side as indicated by arrow 145. One or both of the doors 130 typically also include a plate 131 that covers the space formed between the doors 130, when the doors 130 are closed.

The upper support rail 115 further includes notches 116 and latch stops 117. The notches 116 are adapted to receive latches 140 that are respectively connected to the doors 130 through brackets 135. FIG. 1 illustrates one notch 116 on either side of the aperture. Further notches can be located along the upper support rail 115. The latches 140 rotate with respect to the brackets 135 about a pin 136. Furthermore, the latches 140 are spring loaded on the brackets 135. The latches 140 include an engagement portion 140*a* and a handle portion 140*b*.

Referring still to FIG. 1, one door 130 is shown in the open state with the engagement portion 140*a* of the latch 140 resting on the upper support rail 115. The other door 130 is shown in the closed and locked state with engagement portion 140*a* of the latch 140 engaged with the notch 116. As described above, the latches 140 are spring loaded biased to provide the force against the upper support rail so that when the engagement portion 140*a* passes by a notch 116, the latch engages the notch and locks itself into place. When a user desires to open the doors 130, the user provides a force in the opposite direction of the spring bias by pressing downward on the handle portion 140*b* of the latch 140. This downward force removes the engagement portion 140*a* from the notch 116, thereby unlocking the doors 130. The user can then slide the doors 130 along the track space 126. Once the engagement portions 140*b* are clear of the notches 116, the user can release the handle portions 140*b* which biases the engagement portion 140*a* against the upper support rail 115. As described above, the upper support rail 115 can further include other notches so that the doors can be locked in various positions along the upper support rail 115. Notches can also be provided at the ends of the upper support rail 115 in order to lock the doors 130 into the open state. When the user desires to close the doors 130, the user can simply engage the doors 130 anywhere on the doors 130 and slide the doors 130 along the track space 126 until the engagement portions 140*a* engage the notches 116 and lock the doors 130 into place. The latch stops 117 protrude past the outer edge of the upper support rail 115 to ensure that either door 130 does not overshoot the notches 116. Once the doors 130 are closed and locked into position, the plate 131 covers the space formed between the doors 130, thereby preventing a prisoner from sticking anything through the space.

A back panel 170 is shown in a simulated position. The back panel 170 is adapted to fit over the rear portion of the main body 110 to affix to a prison door over the prison door opening as described further below.

Figure 2:
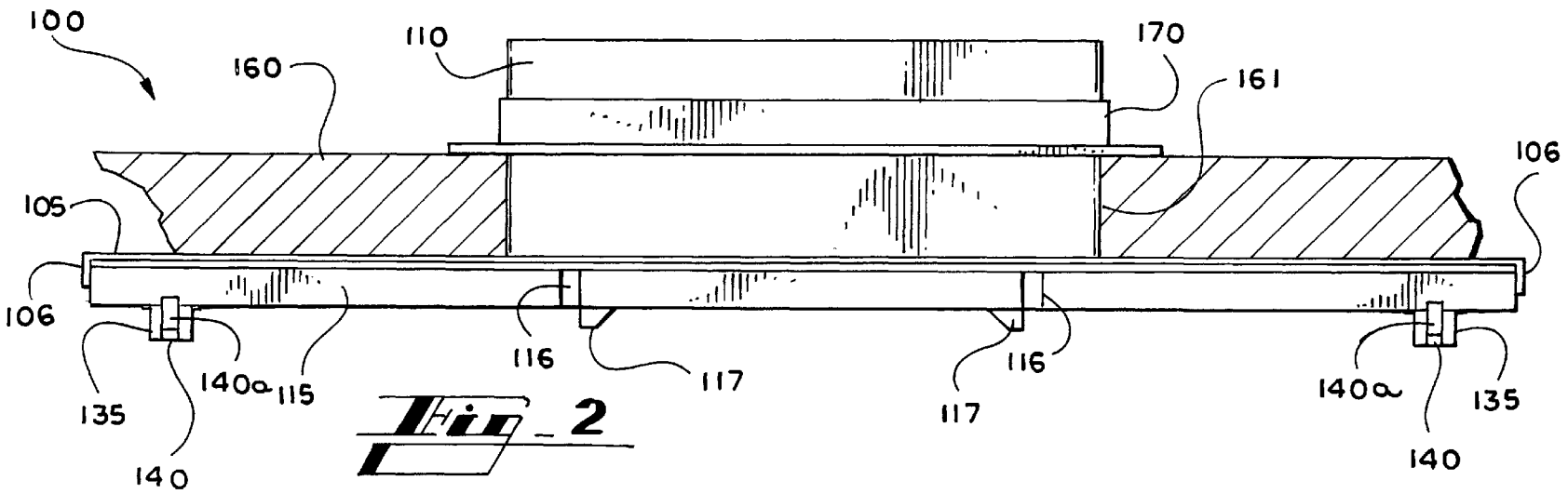
FIG. 2 illustrates a top view of an embodiment of a self-latching slide door apparatus.

FIG. 2 illustrates a top view of an embodiment of a self-latching slide door apparatus 100 positioned within a portion of a prison door 160. The main body 110 fits through the prison door aperture 161 and is secured to the prison door with the rear panel 170. Therefore, the prison door 160 is sandwiched between the front panel 105 and the rear panel. Standard connecting techniques such as welding can affix the slide door 100 into place. It is also understood that the slide door apparatus 100 can be made to be an integral part of the prison door 160. As described above, the front panel 105 is higher and wider than the main body 110 that is fitted into the aperture 161. The higher and wider proportions of the front panel 105 helps to ensure that any spacing created when the main body 110 is affixed into the aperture is covered.

The main body 110 is shown connected to the front panel 105. Also shown in FIG. 2 is the upper support rail 105 with a top view of the notches 116 and the latch stop. Both doors (not shown) are in the opened state and the engagement portions 140*a* of the latches 140 are resting on the upper support rail 115. The end lips 106 support the upper (and lower) support track 115. A portion of the brackets 135 is also shown.

Figure 3:
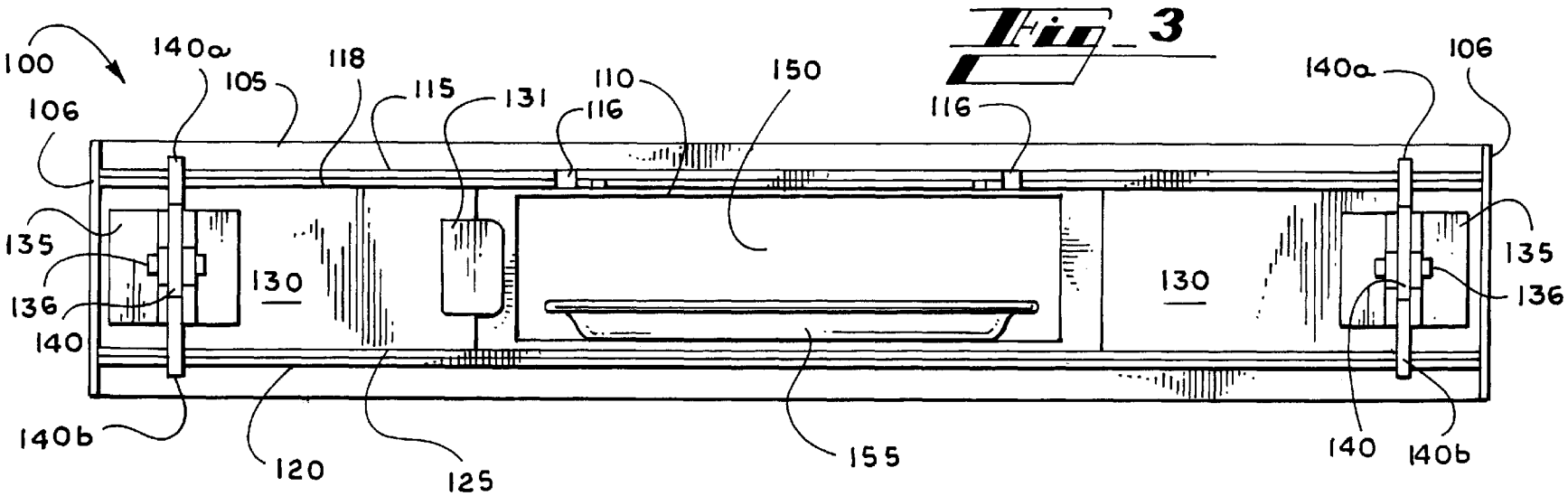
FIG. 3 illustrates a front view of embodiment of a self-latching slide door apparatus in an open state.

FIG. 3 illustrates a front view of embodiment of a self-latching slide door apparatus 100 in an open state. In this open state the doors 130 are fully opened with the engagement portions 140*a* of the latches 140 free from the notches 116 and resting against the upper support rail 115. As described above, the latches 140 are spring loaded within the brackets 135 and rotate about the pins 136. The doors 130 and plate 131 are cleared of the aperture 150. In this front view, both the upper and lower support rails 115, 120 are shown. Both the upper and lower elongated lips 118, 125 are shown forming the track space (not shown) in which the doors 130 travel. The aperture 150 is fully exposed and a food tray 155 is shown in a simulated position within the main body 110.

Figure 4:
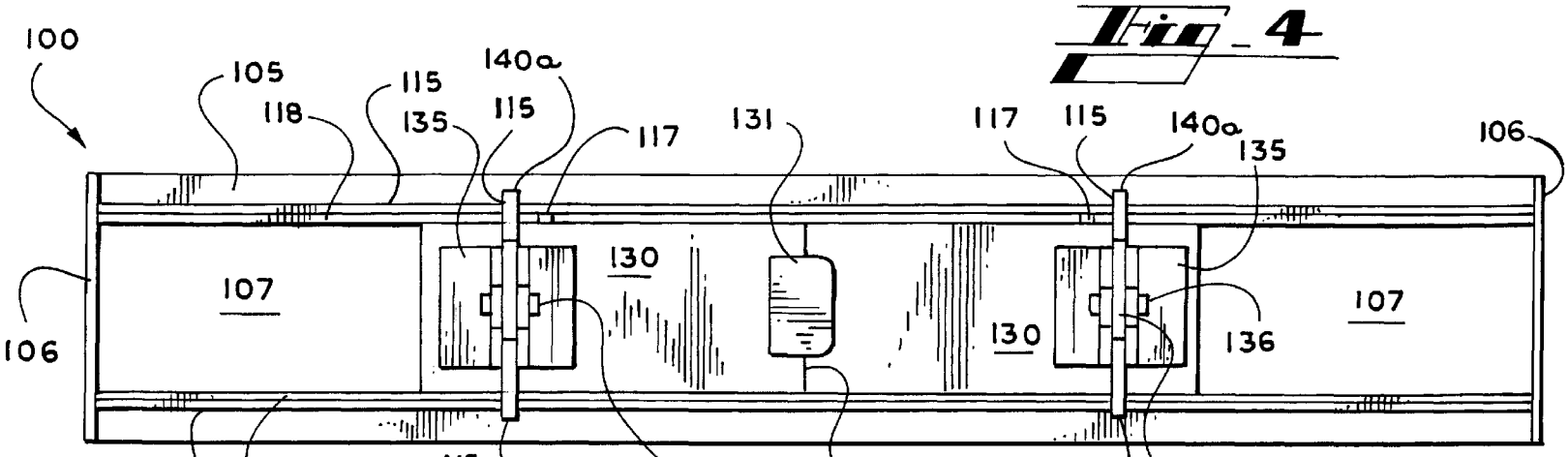
FIG. 4 illustrates a front view of embodiment of a self-latching slide door apparatus in a closed state.

FIG. 4 illustrates a front view of embodiment of a self-latching slide door apparatus 100 in a closed state. In this closed state the doors 130 are fully closed with the engagement portions 140*a* of the latches 140 engaged with the notches 116 and resting against the latch stops 117. As described above, the latches 140 are spring loaded within the brackets 135 and rotate about the pins 136. The doors 130 completely close the aperture (not shown) and the plate 131 covers the majority of the space 171 formed between the closed doors 130. The plate 131 can vary in size to cover more or less of the space 171 as needed. In this front view, further surface portions 107 of the front panel 105 are shown.

Figure 5:
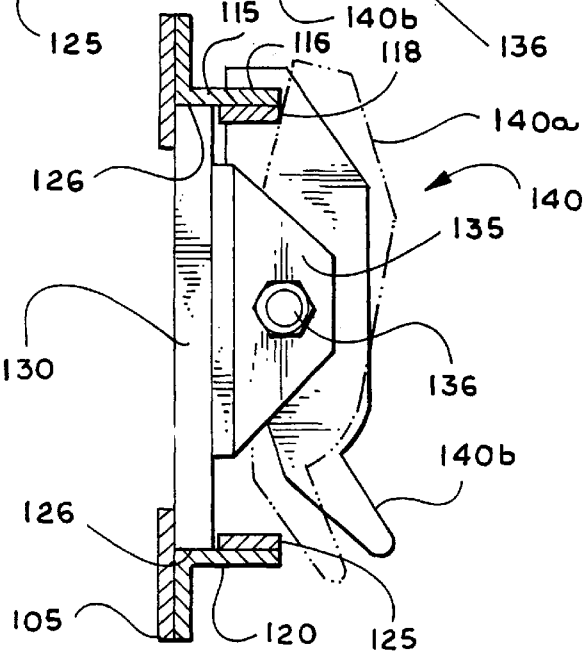
FIG. 5 illustrates a close up side view of an embodiment of a latch for an embodiment of a self-latching slide door apparatus.

FIG. 5 illustrates a close up side view of an embodiment of a latch 140 and a partial side view of a self-latching slide door apparatus 100. The latch 140 is pivotally connected to the bracket 135 by the pin 136. The bracket 135 is connected to the door 130 that is situated between the upper and lower support rails 115, 120, both connected to the front panel 105, and held within the track 126 by the upper and lower elongated lips 118, 125. As described above, the latch includes an engagement portion 140*a* and a handle portion 140*b*. The engagement portion 140*a* of the latch 140 is shown connected within the notch 116 in its biased spring loaded position. The latch 140 is also shown in phantom in a position when the engagement portion 140*a* is disengaged with the notch 116.

The embodiments for the slide door apparatus discussed above have been with respect for prison doors. It is understood that the embodiments can also be implemented in other embodiments for doors, walls and the like that involve the passing of items. For examples, the embodiments discussed above can be implemented in mental wards or other establishments requiring item pass throughs. It is also understood that the embodiments described above can be implemented in any type of establishment including non-security establishments.

In typical implementations, the slide door apparatus the slide door apparatus is constructed of heavy metallic materials. In non-security implementations, the slide door apparatus can be manufactured with lighter materials.

The embodiments described above implemented two slide doors to cover the aperture of the main body. In other embodiments, a single door can be used to cover the aperture. One latch connected to the door could be used to self-latch the door.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A self-latching slide door apparatus, comprising:

a hollow and rectangular main body;

a front panel having an aperture flush with the perimeter of the main body;

an upper and lower support rail connected to the front panel;

a first and second door held within the upper and lower support rails;

a self-latching device connected to each of the doors, the self-latching device including a bracket, a latch spring-loaded within the bracket, the latch having an engagement portion and a handle portion, and a pin pivotally connecting the latch to the bracket;

a first notch located in the upper support rail and adapted to receive the engagement portion of the latch of the first door, the first notch being located so that when the engagement portion of the first door is engaged with the notch, the first door covers substantially half of the aperture; and a second notch located in the upper support rail and adapted to receive the engagement portion of the latch of the second door, the second notch being located so that when the engagement portion of the second door is engaged with the notch, the second door covers substantially the remaining half of the aperture.

2. The apparatus as claimed in claim 1, further comprising:

a first latch stop located near the first notch in a position that prevents the latch of the first door from moving past the first latch stop; and a second latch stop located near the second notch in a position that prevents the latch of the second door from moving past the second latch stop.

3. The apparatus as claimed in claim 2, further comprising a plate connected to the first door, wherein the plate overlaps the second door when doors cover the aperture.

4. A door system, comprising:

a door having a front surface and a rear surface, and having a pass opening;

a slide door apparatus, comprising:

a hollow main body fit flush within the pass opening;

a front panel in contact with the front surface of the door and having an aperture flush with the perimeter of the main body;

a rear panel surrounding the main body and in contact with the rear surface of the door;

an upper and lower support rail connected to the front panel;

a first and second door held within the upper and lower support rails;

a self-latching device connected to each of the doors, the self-latching device including a bracket, a latch spring-loaded within the bracket, the latch having an engagement portion and a handle portion, and a pin pivotally connecting the latch to the bracket;

a first notch located in the upper support rail and adapted to receive the engagement portion of the latch of the first door, the first notch being located so that when the engagement portion of the first door is engaged with the notch, the first door covers substantially half of the aperture; and a second notch located in the upper support rail and adapted to receive the engagement portion of the latch of the second door, the second notch being located so that when the engagement portion of the second door is engaged with the notch, the second door covers substantially the remaining half of the aperture.

5. The system as claimed in claim 4, wherein the first and second doors are adapted to be in a closed state and an open state.

6. The system as claimed in claim 5 further comprising a plate connected to the first door.

7. The system as claimed in claim 6, wherein the plate overlaps the second door when the doors are in the closed state, the plate covering a space between the first and second doors.

* * * * *